US011152691B2

(12) United States Patent
Filatov

(10) Patent No.: US 11,152,691 B2
(45) Date of Patent: Oct. 19, 2021

(54) DUAL BROADBAND ANTENNA SYSTEM FOR VEHICLES

(71) Applicant: Advanced Automotive Antennas, S.L.U., Barcelona (ES)

(72) Inventor: Evgenii Filatov, Viladecavalls (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 146 days.

(21) Appl. No.: 16/442,013

(22) Filed: Jun. 14, 2019

(65) Prior Publication Data

US 2019/0386385 A1 Dec. 19, 2019

(30) Foreign Application Priority Data

Jun. 15, 2018 (EP) ..... 18382428

(51) Int. Cl.
*H01Q 1/32* (2006.01)
*H01Q 5/30* (2015.01)
*H01Q 1/36* (2006.01)

(52) U.S. Cl.
CPC ..... *H01Q 1/325* (2013.01); *H01Q 1/36* (2013.01); *H01Q 5/30* (2015.01)

(58) Field of Classification Search
CPC ..... H01Q 1/32; H01Q 1/3208; H01Q 1/325; H01Q 1/3275; H01Q 1/52; H01Q 1/521; H01Q 1/523; H01Q 1/36; H01Q 1/48; H01Q 5/25; H01Q 5/30; H01Q 5/371; H01Q 9/0414; H01Q 9/30; H01Q 9/32; H01Q 9/36; H01Q 9/38; H01Q 9/40; H01Q 9/42; H01Q 9/44; H01Q 9/46; H01Q 21/24; H01Q 21/28
See application file for complete search history.

(56) References Cited

U.S. PATENT DOCUMENTS 7,535,431 B2 * 5/2009 Rowell ..... H01Q 1/243 343/846
2007/0052589 A1 * 3/2007 Liu ..... H01Q 9/0421 343/700 MS
2008/0094302 A1 4/2008 Murch et al.

FOREIGN PATENT DOCUMENTS

CN 106654555 A 5/2017
CN 107171057 A 9/2017

OTHER PUBLICATIONS

Extended European Search Report for European Application No. 19173851.7; Date of Completion: Nov. 8, 2019; dated Nov. 15, 2019; 6 Pages.

* cited by examiner

*Primary Examiner* — Robert Karacsony
(74) *Attorney, Agent, or Firm* — Cantor Colburn LLP

(57) ABSTRACT

A dual broadband and multiband antenna system of reduced dimension is preferably an external antenna adapted for vehicles. The antenna system comprises first and second radiating elements and a common ground plane for the first and second radiating elements. The ground plane comprises at least three planes, wherein a first and a second planes are parallel to each other, and wherein a third plane is connected with the first and second planes and it is orthogonally arranged with respect to the first and second planes. The first and second planes extend from the third plane in opposite directions so as to define generally a Z shape in a cross-sectional view. The antenna system is preferably adapted to operate on the LTE communication network.

20 Claims, 2 Drawing Sheets

DUAL BROADBAND ANTENNA SYSTEM FOR VEHICLES

CROSS-REFERENCE TO RELATED APPLICATIONS

This patent application claims priority to European Patent Application No. 18382428.3, filed Jun. 15, 2018, which is incorporated herein by reference in its entirety.

BACKGROUND OF THE INVENTION

The present invention refers to broadband and multiband antennas, and more particularly to broadband and multiband antennas used as remote or external antennas for vehicles.

Due to the large size of some electronic devices, it is difficult to accommodate a large antenna system inside a reduced space. For this reason, many communication devices of motor vehicles require remote (external) antennas to increase the performance of an internal antenna. In that scenario, it is critical that the dimension of the external antenna be as small as possible so that it can be fitted inside a reduced space within a vehicle.

One advantage of the external antennas over internal antennas is its performance in terms of electronic noise. Internal antennas should obtain worst sensitivity of the whole system as being nearer of the electronic noise sources (clocks, microprocessors, etc.). Therefore, in case of the external antennas this situation is improved as they can be moved out from these noise sources.

For example, LTE antennas require at the same time both a main antenna and a diversity antenna. However, these two LTE antennas (main and diversity) cannot be accommodated in the narrow interior of a shark fin antenna, especially in the low frequency band (700 MHz-1 GHz), wherein signal interference is high, and the level of the un-correlation obtained between the antennas would be poor. When more than one antenna is needed on a mobile system as LTE, antennas must be as uncorrelated as possible between them.

Furthermore, it is a challenge to integrate a multiband, highly efficient, low VSWR LTE antenna in this reduced dimension.

Therefore, it is desirable to develop an improved antenna system for a vehicle that having a reduced size, offers a high efficiency and a broadband behavior. It would be also desirable that the improved antenna system operates on all LTE frequency bands without losing its broadband and highly efficient characteristics in any band.

SUMMARY OF THE INVENTION

The invention is defined in the attached independent claim, and it refers to an antenna topology that fulfills the above-described challenges of the prior art, by providing an antenna topology that features a broad bandwidth, high efficiency and reduced dimensions.

An object of the present disclosure is to provide a broadband, multiband and high efficiency antenna system of reduced dimensions, that can be fitted within a confined space, for example inside a component of a vehicle.

The antenna system of the present disclosure is preferably adapted to operate on the LTE communication network.

An aspect of the present disclosure refers to a dual broadband antenna system comprising: first and second radiating elements and a common ground plane for the first and second radiating elements. The ground plane comprises at least three differentiated planes placed at different levels or orientations, such as the ground plane features a double-folded shape. For example, a first and a second planes of the ground plane are substantially parallel to each other, and a third plane is transversally arranged with respect to the first and second planes.

The first and second radiating elements are co-planar respectively with the first and second planes of the ground plane, such as the radiating elements are also parallel to each other. The two radiating elements are partially surrounded by the ground plane. First and second feeding points (output ports), are respectively connected with the first and second radiating elements.

Additionally, the first and second planes extend from the third plane in opposite directions, so that the first plane is placed over one face of the third plane, and the second plane is placed over the other face of the third plane, thus, no areas of the first and second planes overlap. In this way, the antenna system defines generally a Z shape, in a cross-sectional view. The technical effect of this arrangement is that a longer electrical length of the antenna system is obtained, which can be efficiently fitted inside an available volume, usually very reduced. Additionally, due to the double-folded configuration of the ground plane, the separation and consequently the isolation between the radiating elements, is enhanced.

Preferably, the first, second and third planes of the ground plane are rectangular, each one having two opposite large sides and two opposing short sides, and wherein the two large sides of the third plane are connected respectively with a large side of the first and second planes.

Preferably, the third plane of the ground plane has a slot that extends from one of its short sides, and wherein the slot is shorter than the large sides of the third plane. This slot provides the effect that the isolation between the first and second radiating elements is increased, and the lowest LTE resonant frequency and the mutual coupling between the two radiating elements, are selected.

The present antenna system is preferably adapted to operate at least within one Long Term Evolution (LTE) frequency band, and to be used as remote antenna for a motor vehicle.

Some of the advantages of the antenna system are summarized below:

Dual LTE antenna;

No need for a ground connection to the vehicle, the antenna is itself grounded;

Multiband behavior;

High efficiency performance;

Compatible to integrate a satellite navigation antenna (GLASS);

Very high bandwidth: (700-960 MHz, 1400-2800 MHz, 3400-3800 MHz, 5000-6000 MHz);

VSWR<2.5 on the 90% of the bandwidth;

Radiation efficiency over 30%, up to 80% at high frequencies; and

Compact geometry, in one example (and as illustrated) maximum dimensions are 80 mm×60 mm×15 mm, thus, it can be integrated within a confined space.

BRIEF DESCRIPTION OF THE DRAWINGS

Preferred embodiments of the present disclosure are henceforth described with reference to the accompanying drawings, wherein:

FIG. 5 shows the same perspective view of FIG. 4, wherein both radiating elements and parasitic elements are visible.

FIG. 6 shows a graph corresponding to the measured VSWR (Voltage Standing Wave Ratio) for the first and second antennas.

FIG. 7 shows a graph corresponding to the measured efficiency for the first and second antennas.

FIG. 8 shows a graph corresponding to the Total Linear Average Gain (LAG) for the first and second antennas.

FIG. 9 shows a graph corresponding to the isolation of the antenna system.

FIG. 10 shows a graph corresponding to the Envelope Cross-Correlation (ECC) of the antenna system.

DETAILED DESCRIPTION

Figure 1:
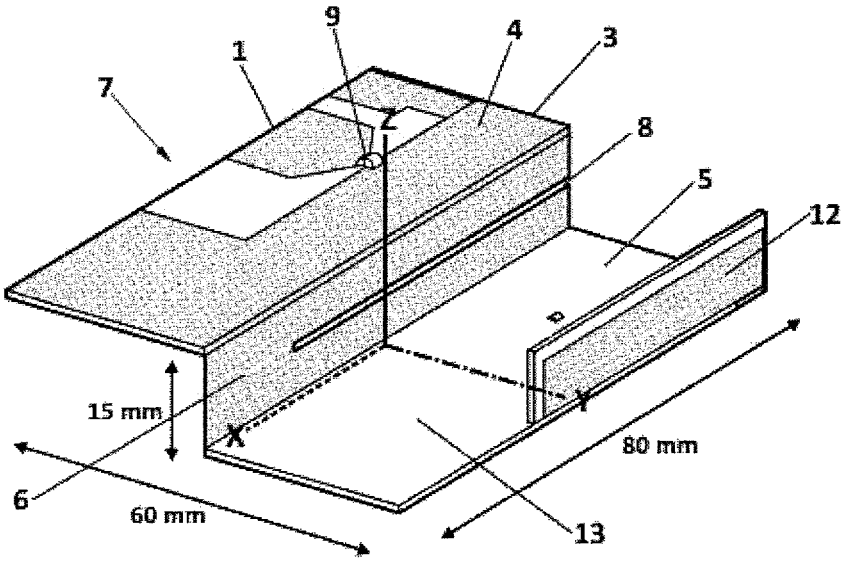
FIG. 1 shows a perspective view from above of an antenna system according to one exemplary, non-limiting, embodiment of the present invention.
Figure 4:
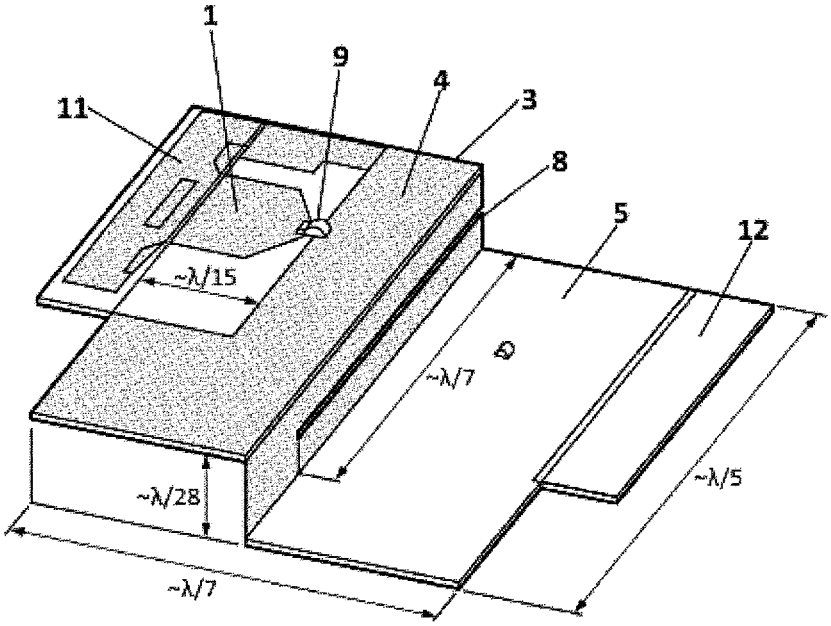
FIG. 4 shows perspective view of another embodiment of the antenna system similar to the one of FIG. 1, but with parasite element and the radiating element coplanar in both antennas.

FIG. 1 shows a preferred embodiment of a dual broadband antenna system 7 comprising first and second radiating elements 1, 2 and a common ground plane 3 for the first and second radiating elements 1, 2. The ground plane 3 comprises three planes, a first plane 4, a second plane 5 and a third plane 6. First and second planes 4, 5 are substantially parallel to each other. As shown in FIG. 4, the distance between the first and second planes 4, 5 is around λ/28.

The third plane 6 is transversally arranged with respect to the first and second planes 4, 5. In the embodiment of FIGS. 1 to 5, the third plane 6 is orthogonally arranged with respect to the first and second planes 4, 5, thereby defining 90° angles with those planes. However, in other preferred embodiments third plane 6 could have any suitable inclination relative to the planes 4, 5, so as to define angles different than 90° with respect to the planes 4, 5.

The first and second radiating elements 1, 2 are co-planar respectively with the first and second planes 4, 5 of the ground plane 3, and they are partially surrounded by the ground plane 3. The first and second planes 4, 5 extend from the third plane 6 in opposite directions, such as no area of the first and second planes overlap, as shown especially in FIG. 3.

The first, second and third planes 4, 5, 6 of the ground plane 3 are generally rectangular, such as each plane has two opposing large sides and two opposing short sides. The two large sides of the third plane 6 are connected at respectively with a large side of the first and second planes 4, 5. In a preferred embodiment, the third plane 6 is orthogonally arranged with respect to the first and second planes 4, 5, but in other embodiments the third plane 6 can be inclined first and second planes 4, 5.

The shape of the first and second radiating elements 1, 2 is generally a rectangle with two cut outs at two corners so as to configure a triangular shape. The electric length of the radiating elements 1, 2 is around λ/15, as shown in FIG. 4. The antenna system 7 has first and second feeding points 9, 10 (output ports), respectively connected with the first and second radiating elements 1, 2, in particular, connected with the vertex of said triangular form.

Alternatively, the radiating elements 1, 2 can configured as the radiating element 4 described in the European patent application EP 3,270,461 which is hereby incorporated to this description by reference.

Furthermore, the third plane 6 of the ground plane 3 has a slot 8 that extends from one of the short sides of third plane 6. The slot 8 is shorter than the large sides of the third plane 6, for example the electric length of this slot 8 is around λ/7, as shown in FIG. 4. Preferably the slot 8 is straight.

The two radiating elements 1, 2 are closer to the short side of the third plane 6 of the ground plane, from which the slot 8 extends. This arrangement of the slot 8 of the ground plane, placed between the two radiating elements 1, 2, increases the isolation between the two radiating elements 1, 2 of the antenna system.

Additionally, the two radiating elements 1, 2 have substantially the same area and shape, and arranged such as they are a mirror image of each other (with respect to the third plane 6) in a top plan view of the antenna system 7, as it can be appreciated in FIG. 5.

Also, as shown in FIG. 5, the ground plane 3 has two L-shaped arms 11, 12 that partially surround respectively the first and second radiating elements 1, 2 on the first and second plane 4, 5. These L-shaped arms 11, 12 are parasitic elements for the two radiating elements 1, 2, and in this embodiment, they are coplanar with the radiating elements 1, 2. Those elements 11, 12 are connected to ground in a similar way as the one described in the above-captioned European patent application EP 3,270,461 regarding the parasitic element 5.

Figure 2:
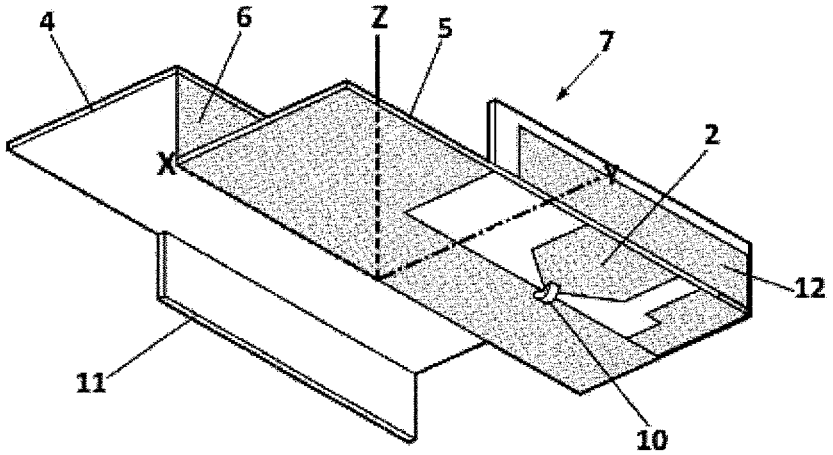
FIG. 2 shows perspective view from below of the preferred embodiment of FIG. 1.
Figure 3:
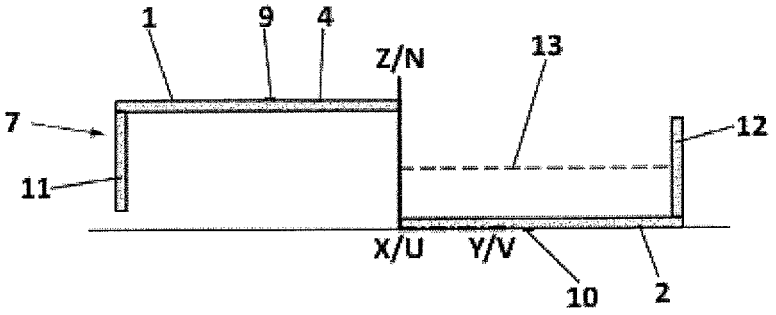
FIG. 3 shows a cross-sectional view of the embodiment of FIGS. 1 and 2.

Alternatively, in the embodiment of FIGS. 1, 2 and 3, the L-shaped arms 11, 12 are folded in order to reduce the volume of the antenna system. In this case, the ground plane 3 further comprises a fourth and fifth planes 11, 12 that are preferably parallel to each other and also preferably orthogonal to the first and second planes 4, 5. The fourth and fifth planes 11, 12 are placed such as they are facing each other, that is, they are in opposite each other, as more clearly shown in FIG. 3.

These parasitic L-shaped arms 11, 12 of the ground plane, are capacitively coupled respectively with the radiating elements 1, 2, through a close proximity region, in which a straight side of the arms 11, 12 and a straight side of the radiating element, are parallel to each other and closely spaced.

The antenna system 7 additionally comprises a satellite navigation antenna (GNSS) 13, attached to an interior surface of the first or second plane 4, 5 of the ground plane 3, as represented in FIG. 3.

As shown in FIG. 1, the antenna system 7 fits inside a rectangular prismatic volume which larger side is 80 mm long, and the other two sides are 60 mm and 15 mm.

Taking in account that the lowest frequency of operation is at 700 MHz and the velocity of wave propagation over the air (v=3e8 m/s) the operative wavelength is (λ=v/f=3e8/700e6=428 mm). As described on FIG. 4 in terms of wavelength the larger 80 mm side is a ratio of λ/5 and the shorter side of 60 mm as a ratio of λ/7. For the rest of the antenna structure dimensions can be related with the defined operative wavelength value.

The first and second planes 4, 5 are implemented as Printed Circuit Boards (PCB's), wherein the radiating elements 1, 2 and the two planes 4, 5 are formed as conductive layers on one of the PCB's surfaces, preferably in upper and lower surfaces, that is, in opposite surfaces of the PCB's, such as the interior surfaces of the PCB's are non-conductive. The (GNSS) antenna 13 is placed on an interior non-conductive surface of one of the PCB's.

As shown in the graphs of FIGS. 6, 7 and 9, 10, the antenna system 7 is adapted to operate at least within one Long Term Evolution (LTE) frequency band. Preferably, the antenna system 7 is shaped and dimensioned such as the lowest frequency of operation is 700 MHz.

While the above disclosure has been described with reference to exemplary embodiments, it will be understood by those skilled in the art that various changes may be made, and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed but will include all embodiments falling within the scope thereof.

The invention claimed is:

1. A dual broadband antenna system for vehicles, the antenna system comprising:

first and second radiating elements and a common ground plane for the first and second radiating elements, the ground plane comprising at least three planes, wherein a first and a second planes are substantially parallel to each other, and wherein a third plane is connected with the first and second planes and it is transversally arranged with respect to the first and second planes, and wherein the first and second planes extend from the third plane in opposite directions, wherein the first and second radiating elements are coplanar respectively with the first and second planes of the ground plane, and wherein the antenna system further comprises first and second feeding points, respectively connected with the first and second radiating elements, and wherein the first feeding point is connected directly between the first radiating element and the first plane, and the second feeding point is connected directly between the second radiating element and the second plane.

2. The antenna system according to claim 1, wherein the first, second and third planes of the ground plane are rectangular, each one having two opposite large sides and two opposing short sides, and wherein the two large sides of the third plane are connected respectively with a large side of the first and second planes.

3. The antenna system according to claim 1, wherein the first and second radiating elements are partially surrounded by the ground plane.

4. A dual broadband antenna system for vehicles, the dual broadband antenna system comprising:

first and second radiating elements and a common ground plane for the first and second radiating elements, the ground plane comprising at least three planes, wherein a first and a second planes are substantially parallel to each other, and wherein a third plane is connected with the first and second planes and it is transversally arranged with respect to the first and second planes, wherein the first and second planes extend from the third plane in opposite directions, wherein the first and second radiating elements are coplanar respectively with the first and second planes of the ground plane, wherein the antenna system further comprises first and second feeding points, respectively connected with the first and second radiating elements, and wherein the third plane of the ground plane has a slot that extends from one of its short sides, and wherein the slot is shorter than the large sides of the third plane.

5. The antenna system according to claim 4, wherein the first and second radiating elements are closer to the short side of the third plane of the ground plane, from which the slot extends.

6. The antenna system according to claim 1, wherein the first and second radiating elements have substantially the same area and shape.

7. A dual broadband antenna system for vehicles, the dual broadband antenna system comprising:

first and second radiating elements and a common ground plane for the first and second radiating elements, the ground plane comprising at least three planes, wherein a first and a second planes are substantially parallel to each other, and wherein a third plane is connected with the first and second planes and it is transversally arranged with respect to the first and second planes, wherein the first and second planes extend from the third plane in opposite directions, wherein the first and second radiating elements are coplanar respectively with the first and second planes of the ground plane, wherein the antenna system further comprises first and second feeding points, respectively connected with the first and second radiating elements, and wherein the ground plane has two L-shaped arms that partially surround respectively the first and second radiating elements.

8. A dual broadband antenna system for vehicles, the dual broadband antenna system comprising:

first and second radiating elements and a common ground plane for the first and second radiating elements, the ground plane comprising at least three planes, wherein a first and a second planes are substantially parallel to each other, and wherein a third plane is connected with the first and second planes and it is transversally arranged with respect to the first and second planes, wherein the first and second planes extend from the third plane in opposite directions, wherein the first and second radiating elements are coplanar respectively with the first and second planes of the ground plane, wherein the antenna system further comprises first and second feeding points, respectively connected with the first and second radiating elements, and wherein the ground plane further comprises a fourth and fifth planes that are parallel to each other and orthogonal to the first and second planes, wherein the fourth and fifth planes are facing the third plane.

9. A dual broadband antenna system for vehicles, the dual broadband antenna system comprising:

first and second radiating elements and a common ground plane for the first and second radiating elements, the ground plane comprising at least three planes, wherein a first and a second planes are substantially parallel to each other, and wherein a third plane is connected with the first and second planes and it is transversally arranged with respect to the first and second planes, wherein the first and second planes extend from the third plane in opposite directions, wherein the first and second radiating elements are coplanar respectively with the first and second planes of the ground plane, wherein the antenna system further comprises first and second feeding points, respectively connected with the first and second radiating elements, and a global navigation satellite system (GNSS) antenna attached to an interior surface of the first or second plane of the ground plane.

10. The antenna system according to claim 1, wherein the antenna system fits inside a rectangular prismatic volume where a larger side is λ/5 long, and wherein λ is the operative wavelength.

11. The antenna system according to claim 1, adapted to operate at least within one Long Term Evolution (LTE) frequency band.

12. The antenna system according to claim 11, wherein the lowest frequency of operation is 700 MHz.

13. The antenna system according to claim 2, wherein the first and second radiating elements are partially surrounded by the ground plane.

14. The antenna system according to claim 3, wherein the third plane of the ground plane has a slot that extends from one of its short sides, and wherein the slot is shorter than the large sides of the third plane.

15. The antenna system according to claim 4, wherein the first and second radiating elements are closer to the short side of the third plane of the ground plane, from which the slot extends.

16. The antenna system according to claim 5, wherein the first and second radiating elements have substantially the same area and shape.

17. The antenna system according to claim 6, wherein the ground plane has two L-shaped arms that partially surround respectively the first and second radiating elements.

18. The antenna system according to claim 6, wherein the ground plane further comprises a fourth and fifth planes that are parallel to each other and orthogonal to the first and second planes, wherein the fourth and fifth planes are facing the third plane.

19. The antenna system according to claim 8, further comprising a global navigation satellite system (GNSS) antenna attached to an interior surface of the first or second plane of the ground plane.

20. The antenna system according to claim 9, wherein the antenna system fits inside a rectangular prismatic volume where a larger side is λ/5 long, and wherein λ is the operative wavelength.

* * * * *